US010229664B2

(12) United States Patent
Lance et al.

(10) Patent No.: US 10,229,664 B2
(45) Date of Patent: Mar. 12, 2019

(54) VOLTAGE CONTROLLED OSCILLATOR WITH VARIABLE CORE FOR ELECTRONIC MUSICAL INSTRUMENT AND RELATED METHODS

(71) Applicant: MOOG MUSIC, INC., Asheville, NC (US)

(72) Inventors: Cyril Lance, Chapel Hill, NC (US); Michael Ashton, Alexander, NC (US)

(73) Assignee: Moog Music, Inc., Asheville, NC (US)

( * ) Notice: Subject to any disclaimer, the term of this patent is extended or adjusted under 35 U.S.C. 154(b) by 29 days.

(21) Appl. No.: 15/111,641

(22) PCT Filed: Jan. 23, 2015

(86) PCT No.: PCT/US2015/012659
§ 371 (c)(1),
(2) Date: Jul. 14, 2016

(87) PCT Pub. No.: WO2015/112845
PCT Pub. Date: Jul. 30, 2015

(65) Prior Publication Data

US 2016/0335998 A1 Nov. 17, 2016

Related U.S. Application Data

(60) Provisional application No. 61/930,594, filed on Jan. 23, 2014.

(51) Int. Cl.
*G10H 1/00* (2006.01)
*G10H 5/00* (2006.01)
*G10H 5/10* (2006.01)

(52) U.S. Cl.
CPC ..... *G10H 5/002* (2013.01); *G10H 5/10* (2013.01)

(58) Field of Classification Search
CPC ..... G10H 5/002; G10H 5/10
USPC ..... 84/671
See application file for complete search history.

(56) References Cited

U.S. PATENT DOCUMENTS 4,028,978 A 6/1977 Okamoto
4,038,496 A 7/1977 Feezor
4,375,776 A * 3/1983 Okamoto ..... G10H 5/002 84/345
4,379,422 A * 4/1983 Munch ..... G10H 1/10 84/655
4,395,930 A * 8/1983 Deforeit ..... G10H 5/07 84/617
4,402,243 A * 9/1983 Deforeit ..... G06F 7/62 84/604

(Continued)

FOREIGN PATENT DOCUMENTS

GB 1 447 544 8/1976

OTHER PUBLICATIONS

International Search Report and Written Opinion for PCT/US15/12659 dated Apr. 20, 2015.

*Primary Examiner* — Jeffrey Donels
(74) *Attorney, Agent, or Firm* — Myers Bigel, P.A.

(57) ABSTRACT

A signal generator for a musical instrument includes a voltage-controlled oscillator (VCO) comprising a control voltage input and a VCO output. The control voltage input controls a frequency of the VCO output. A controller is configured to control the voltage-controlled oscillator by inputting a sequence of analog control voltages from a plurality of preloaded control voltage inputs.

22 Claims, 4 Drawing Sheets

(56) References Cited

U.S. PATENT DOCUMENTS 4,463,647 A * 8/1984 Luce ..... G10H 1/02
84/684
RE32,838 E 1/1989 Suzuki

* cited by examiner

| MODE | |
|---|---|
| "VAR-CORE" | "VCO" |
| SLOPE 1 | SLOPE 1 |
| SLOPE 2 | SLOPE 2 |
| | |
| SLOPE 3 | AMPL-1 |
| SLOPE 4 | AMPL-2 |

VOLTAGE CONTROLLED OSCILLATOR WITH VARIABLE CORE FOR ELECTRONIC MUSICAL INSTRUMENT AND RELATED METHODS

RELATED APPLICATIONS

The present application is a 35 U.S.C. § 371 national phase application of PCT International Application No. PCT/US2015/0012659, filed Jan. 23, 2015, which claims priority from U.S. Provisional Application No. 61/930,594, filed Jan. 23, 2014, the disclosures of which are hereby incorporated herein in their entirety. PCT International Application No. PCT/US2015/012659 is published in English as PCT Publication No. WO 2015/112845.

FIELD OF THE INVENTION

The present invention relates to voltage-controlled oscillators for electronic musical instruments, and in particular, to voltage-controlled oscillators with a variable core.

BACKGROUND

In a voltage-controlled oscillator (VCO), a capacitor is charged through a constant current source which is controlled by a control voltage and discharges upon reaching a predetermined charging potential, which results in an oscillation of a typically saw-tooth wave signal corresponding in frequency to the control voltage. The frequency of oscillation can be varied over a relatively wide range by changing the input control voltage. Traditional VCO's have used some variation of a comparator to compare the voltage across the capacitor to a target voltage and, once the target voltage is reached, triggering a resetting of the voltage across the capacitor so that the charging cycle repeats itself and oscillates.

Two traditional VCO topology examples are the integrator-reset oscillator and the exponential oscillator.

The exponential oscillator uses the exponential response of the current across the transistor as related to the input voltage across the base-emitter junction. A drawback to this type of oscillator design is temperature drift and stability due to thermal fluctuations. Because the exponential response of the transistor junction is intrinsically related to the temperature of that junction, VCOs that are driven by exponentiators are vulnerable to the effects of temperature drift. Various methods to overcome this temperature dependence have been developed over the last 50 years, most notably using tempco resistors (temperature-compensated) in the exponentiator and summing amplifiers and/or by heating the transistor junctions to a known constant temperature that is hotter than the ambient so that the transistors remain, in theory, at a constant temperature.

These methods, however, have their technical issues and limitations and neither can fully account for all temperature fluctuations and can take long times to warm up and come to true pitch. Another practical drawback to these approaches is the added manufacturing costs associated with highly matched transistor packages or tempco resistors.

An integrator-reset oscillator uses a simple op-amp integrator circuit with a FET or analog switch to short out the integrating capacitor when the target voltage has been reached. These oscillators are typically very easy to put together and require no costly or specialized components.

The advantage of the op-amp integrator is that the temperature dependencies are minimized (capacitors and resistors do exhibit small temperature dependencies but not on the scale discussed above in the exponentiators). These oscillators come to pitch within about 60 seconds and hold their pitch accuracy over a wide range of normal operating conditions.

The disadvantage of the op-amp integrator is that there is no exponentiation: in other words, these oscillators do not use volt-per-octave input control voltage, but rather require the inputs to be in the exponential scale already.

Typically, these oscillators have been used on instruments with a smaller pitch range where the exponential scale is not such a liability.

Traditional modular synthesizers of the early 1960's and 1970's generated control-voltages from a number of analog sources. As music technology evolved, the need for integrating analog synthesizer components such as VCOs into the digital controlled world of music production became an imperative.

Traditionally, control-voltages were created digitally by using a Digital-To-Analog Converter (or DAC). Early on, these DAC's were very expensive, slow and low-resolution generating control-voltages that were highly compromised due to these limitations.

Generating large numbers of control-voltages simultaneously required the use of a high-precision DAC (typically 16-bits of resolution) and a matrix of analog switches feeding this signal into an array of sample-hold circuits further compromising the final control-voltage by reducing the temporal resolution as well as creating switching artifacts such as charge-injection from the analog switches and sample-hold degradation due to leakage.

Another common way to generate voltages from a microprocessor is by use of PWM (pulse-width modulation). Using a digital output from the micro-processor, a series of pulses are generated of varying width. These are fed into a low-pass filter that in essence integrates the pulse widths and transforms them into a voltage that is proportional to the width (or duty-cycle) of the pulse.

PWM has the advantage of being very low-cost to implement and very easy to control via the micro-processor. The disadvantages have always been the resolution and frequency of the PWM clock which are limited by the hardware design of the micro-processor.

SUMMARY

In some embodiments, a signal generator for a musical instrument includes a voltage-controlled oscillator (VCO) comprising a control voltage input and a VCO output. The control voltage input controls a frequency of the VCO output. A controller is configured to control the voltage-controlled oscillator by inputting a sequence of analog control voltages from a plurality of preloaded control voltage inputs.

In some embodiments, the controller is further configured to select at least one of the plurality of preloaded control voltage inputs and to simultaneously preload another of the plurality of control voltage inputs for subsequent selection.

In some embodiments, the controller is configured to receive the VCO output and to adjust the control voltage sequence based on a comparison between a desired waveform output and the VCO output.

In some embodiments, the control voltage sequence of analog control voltages is selected by random and/or arbitrary variable generation, is based on a desired waveform selected by a user and/or is based on control voltages and/or other parameters selected by a user.

In some embodiments, a comparator defines an amplitude of the VCO output, and the controller is further configured to control the amplitude defined by the comparator using a sequence of preloaded comparator voltages.

In some embodiments, the voltage-controlled oscillator comprises at least one reset input configured to reset a phase of the VCO output, and the controller is configured to control the at least one reset input.

In some embodiments, the controller further comprises at least one control voltage selection multiplexer configured to select one of the plurality of control voltage inputs.

In some embodiments, an analog mode multiplexer is configured to select between a microprocessor control mode and a conventional voltage controlled oscillator mode in which microprocessor control is disabled.

In some embodiments, the controller is configured to combine at least two of the plurality of preloaded control voltage inputs to provide a modified control voltage input to the voltage controlled oscillator. Combining ones of the plurality of preloaded control voltages may include adding and/or multiplying at least two of the plurality of preloaded control voltage inputs.

In some embodiments, the controller comprises a microprocessor.

According to some embodiments, a musical instrument is provided including the signal generator described herein; and a tone generator configured to produce a sound responsive to the VCO output.

According to further embodiments, a method for generating a signal for a musical instrument include providing a voltage-controlled oscillator (VCO) comprising a control voltage input and a VCO output, wherein the control voltage input controls a frequency of the VCO output; and controlling the voltage-controlled oscillator by inputting a control voltage sequence of analog control voltages selected from a plurality of preloaded control voltage inputs.

BRIEF DESCRIPTION OF THE DRAWINGS

The accompanying drawings, which are included to provide a further understanding of the disclosure and are incorporated in and constitute a part of this application, illustrate certain non-limiting embodiment(s) of the invention. In the drawings.

DETAILED DESCRIPTION OF EMBODIMENTS OF THE INVENTION

Figure 1:
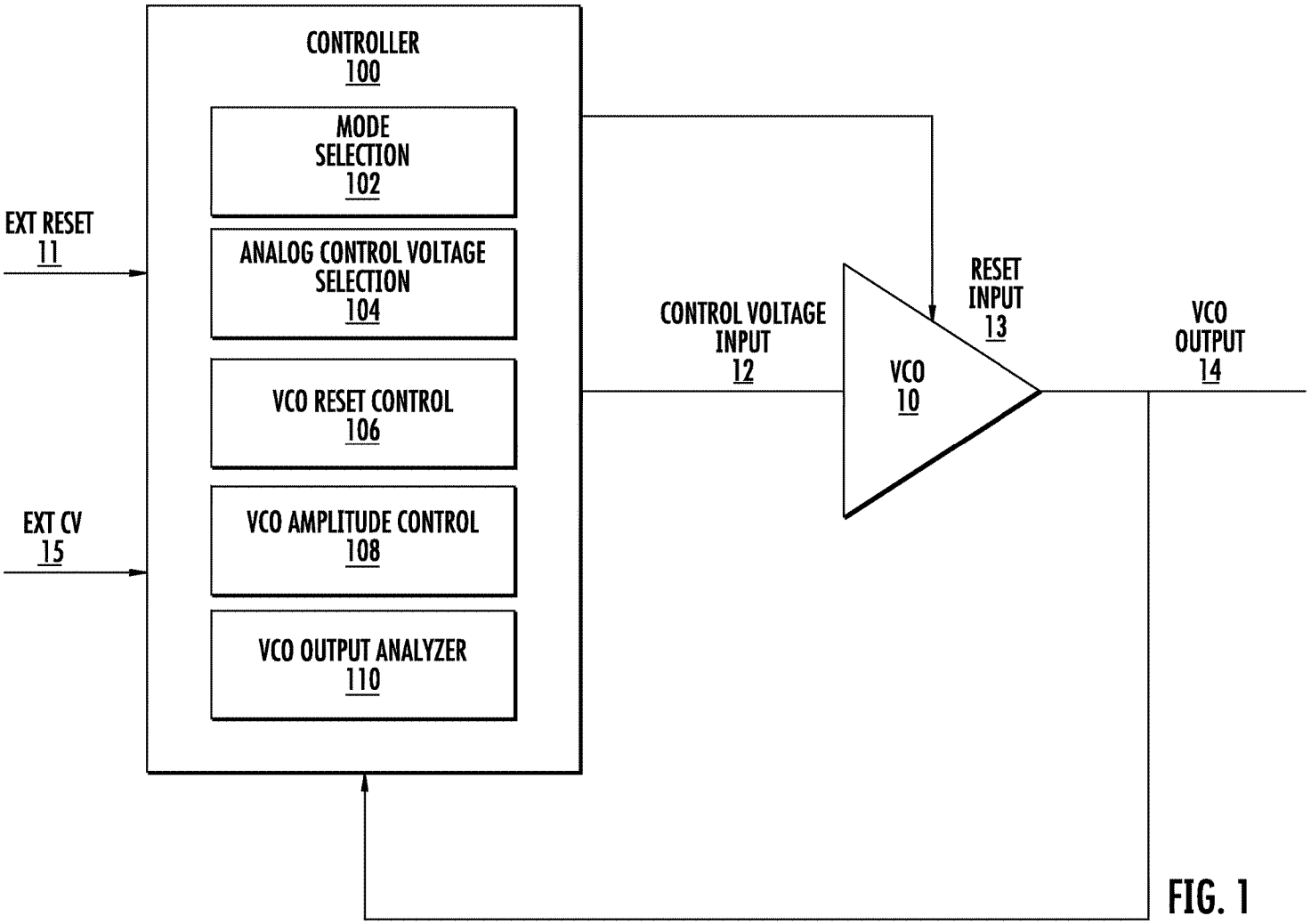
FIG. 1 is a schematic diagram of a sound signal generator for a musical instrument according to some embodiments.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

The present invention is described below with reference to block diagrams and/or flowchart illustrations of methods, apparatus (systems) and/or computer program products according to embodiments of the invention. It is understood that each block of the block diagrams and/or flowchart illustrations, and combinations of blocks in the block diagrams and/or flowchart illustrations, can be implemented by computer program instructions and/or hardware components. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, embodiments of the present invention may take the form of a computer program product on a computer-usable or computer-readable non-transient storage medium having computer-usable or computer-readable program code embodied in the medium for use by or in connection with an instruction execution system.

The computer-usable or computer-readable medium may be, for example but not limited to, an electronic, optical, electromagnetic, infrared, or semiconductor system, apparatus, or device. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM).

A variable core, voltage-controlled oscillator (VC-VCO) may be provided. In some embodiments, a bipolar configuration in a voltage-controlled oscillator (VCO) may be both charged and discharged allowing the VCO to have slopes of opposite polarity. The VCO is charged and discharged through a current source derived by a control voltage. Timing is determined by capturing when the VCO output reaches a predetermined charging potential determined by a comparator or by changing the direction and/or magnitude of the charging current by changing the polarity of the control voltage through direct intervention from, but not limited to, an external source such as a microprocessor. A conventional VCO generally results in an oscillation of a typically saw-tooth or triangle waveform varying in frequency with the control voltage. In some embodiments, a complex set of waveforms, including traditional waveforms such as SAW, RAMP, TRIANGLE, SQUARE and PULSE in the VC-VCO core, but additionally including the ability to create multi-timbral effects like wavefolding, duty-cycle modulation, smooth curves, and a vast array of new sounds directly from the VCO core may be achieved.

Accordingly, the VCO core is controlled by a control-voltage. In some embodiments, this control-voltage can be the sum of a number of different sources including traditional analog voltages, voltages generated from a microprocessor using a high-quality, high-resolution DAC, and voltages generated from a microprocessor using high-resolution PWM hardware implementations. Additionally, these control voltages can be multiplied together to enable modulation of the control-voltage input. In some embodiments, the creation of arbitrary complex control-voltage input waveforms may be achieved.

By coupling the hardware described herein with microprocessor control, a traditional VCO topology may be transformed into a "variable-core VCO" that may be capable of creating extremely complex and non-traditional VCO waveforms.

As illustrated in FIG. 1, a voltage-controlled oscillator (VCO) core 10 includes a control voltage input 12, a reset input 13, and a VCO output 14. The control voltage 12 controls a frequency of the VCO output 14 and the reset input 13 allows the charging element to be reset (fully discharged). Additionally, external reset source 11 and control-voltage 15 may be input into the controller 100. The controller 100 can be a wide-ranging implementation of some hardware circuits to control the VCO core 10 and a microprocessor to configure, interact, and/or control the VCO core 10 through various input mechanisms. The controller 100 controls the voltage-controlled oscillator and additionally receives a feedback signal from the VCO output 14 which can be interfaced through standard hardware such as comparators and/or ADCs (analog-to-digital converters). The VCO output 14 may be used as a sound signal, e.g., in a tone generator of an electronic musical instrument, such as an electronic music synthesizer. A series of VCO's may be used to create various sounds for a musical instrument. The controller 100 may include a mode selection module 102 for selecting between a microprocessor-controlled variable core VCO mode and a VCO mode in which the microprocessor controls are disabled, allowing the VCO-core to run completely autonomously without any MCU intervention and allowing the invention to have a truly analog VCO mode. The analog control voltage selection module 104 allows the controller to have precision control of what control voltages are being inputted into the VCO 10 based on the configuration and timing of the oscillator. The analog control voltage selection module 104 may select analog control voltages from a plurality of preloaded control voltage inputs. The analog control voltages may be used as inputs to the variable core VCO 10 such that a desired waveform may be output from the VCO 10. The analog control voltage selection module 104 may input one of the plurality of preloaded control voltage inputs to the VCO and simultaneously preload another of the plurality of control voltage inputs for subsequent selection. In this configuration, rapid switching between control voltage signals may be achieved while maintaining an analog architecture to achieve a desired sound quality.

The controller 100 may also include a VCO reset control 106, a VCO amplitude control 108 and a VCO output analyzer 110. The VCO 10 may include a reset input 13 that resets a phase of the VCO output 14 and is controlled by the VCO reset control 106 of the controller 100. The VCO core 10 may be connected to a comparator that defines an amplitude of the VCO output 14 using a control signal from the VCO amplitude control 108. The VCO output analyzer 110 may analyze the VCO output 14, for example, to compare a desired waveform to an actual waveform and to determine any modifications to the control voltage sequence or other control inputs to the VCO 10 based on the comparison.

Figure 2:
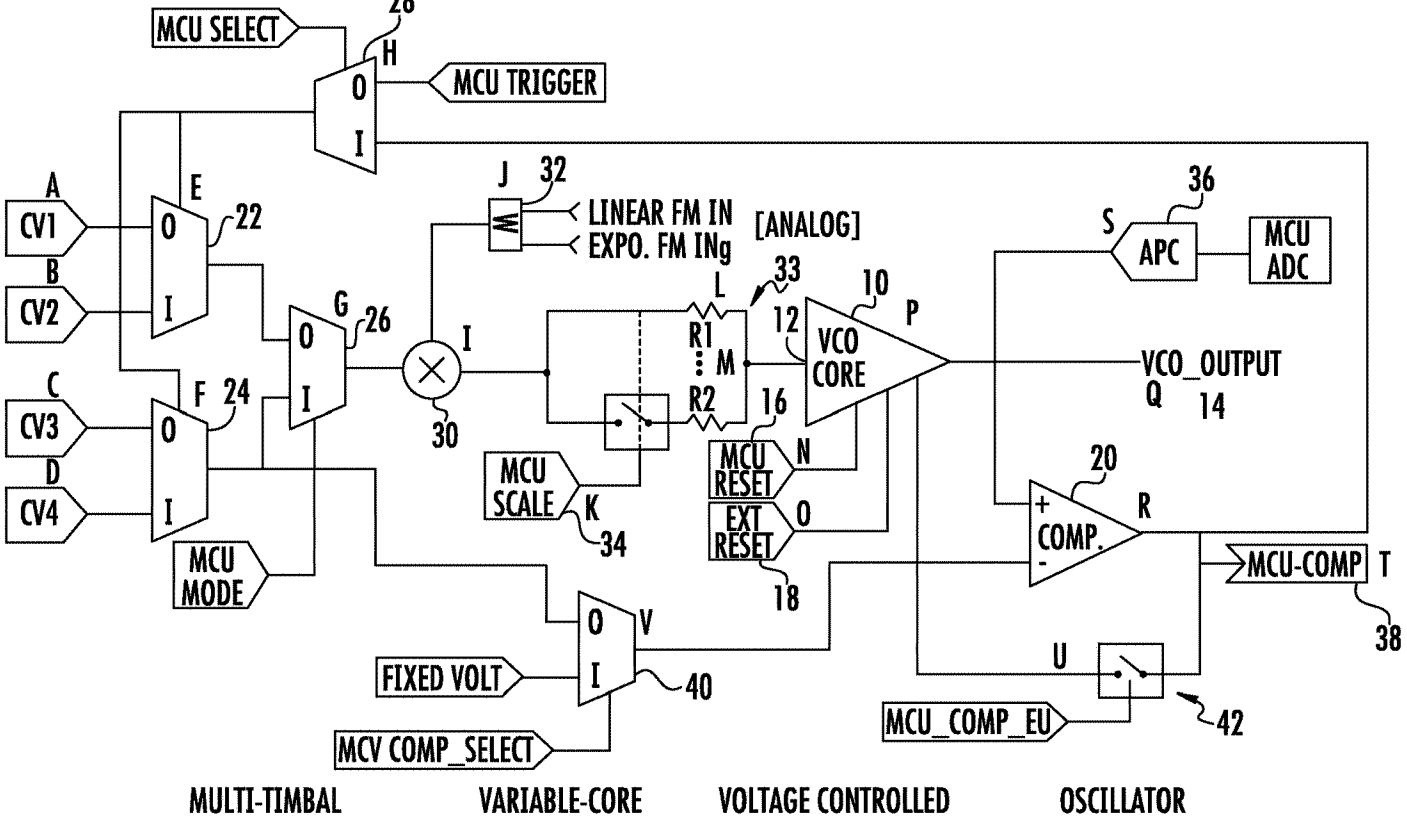
FIG. 2 is a circuit diagram of a circuit including the voltage controlled oscillator of FIG. 1 according to some embodiments.

A particular example of a voltage controlled oscillator circuit is illustrated in FIG. 2. The VCO core 10 has a control voltage input 12, a VCO output 14, a microcontroller reset 16, an external reset 18 and a comparator 20. A plurality of control voltages CV1, CV2, CV3 and CV4 may be selected as inputs to the control voltage input 12. Analog multiplexers 22, 24 may be used to allow the selection of the control voltages CV1, CV2, CV3 or CV4 to the VCO core 10. Analog multiplexers 26, 28 allow selection between a VCO mode and a variable core mode. A VCO input multiplier 30 and external inputs 32 allow external inputs, including analog inputs, to be parallel inputs to the VCO core 10, which allows for both linear and exponential inputs into the VCO core 10. The input 12 may also include an input switchable scale to modify the scale of the slop input to the VCO core 10. As illustrated, the input switchable scale includes resistive elements 33 and a microcontroller controlled switch 34 that changes the scale of the slope input to the VCO core 10. This may permit a larger range of frequency transitions, for example, from sub-audio to super-audio and allow for pseudo-reset segments in the waveform in both the VCO and variable core modes.

As illustrated, when the multiplexer 26 has a value of zero and the multiplexer 28 has a value of one, CV1 and CV2 are selectable as slope or frequency inputs into the VCO core 10, and CV3 and CV4 are selectable as comparator amplitude voltages. This is a VCO mode in which the controller 100 is configured such that the VCO 10 can run without any timing intervention from a microprocessor that allows for a purely analog implementation of the VCO 10. In this mode, the output of the comparator 20 is used to control the multiplexers 22, 24 and, optionally, as a reset voltage to the VCO core 10. When the multiplexer 26 has a value of one and the multiplexer 28 has a value of one, then all of the control voltages CV1, CV2, CV3 and CV4 are selectable as slope input to the VCO core 10. This is a "variable core" VCO mode in which various inputs are controlled by the controller 100. For example, the multiplexers 22, 24 are controlled by the controller 100 to select one of the control voltages CV1, CV2, CV3 and CV4 as a slope or frequency input to the VCO core 10.

An analog to digital converter (ADC) 36 may be external or internal to the controller 100 and may allow the controller 100 to measure and analyze the output, such as with the VCO output analyzer 110 (FIG. 1). The ADC 36 and the VCO output analyzer 110 may analyze the VCO output 14 to provide control values, such as target transitions for a desired waveform or waveform segment. The ADC 36 allows the controller 100 to perform both analytical measurements and replace the functionality of the analog comparator 20, thus freeing up CV3 and CV4 to be used as additional control voltage inputs into the VCO core 10. This is important because it increases the flexibility and the complexity of waveforms generated by the invention.

The comparator 20 may be external or internal to the controller 100 and may allow the controller 100 to determine and/or define waveform transition points. When the multiplexer 28 is set to "1," the comparator 20 may be used to dynamically select the VCO control voltage inputs CV1, CV2, CV3 and CV4 for analog VCO operations. The comparator 20 may have an output 38 that is received by the controller 100 for further analysis, e.g., to set timing controls. The comparator output 38 may also be connected by a controller 100 controlled switch 42 as another reset input to the VCO core 10.

The control voltages CV1, CV2, CV3 and CV4 may be generated in an analog environment, for example, using traditional DACs or pulse width modulator (PWM) pulse streams generated either externally or internally to the controller 100. Low resolution to 24-bit audio DACs may be used. Although four control voltages are illustrated, it should be understood that any number of control voltages may be used. The control voltages may include control voltages that are the sums or multiplication of additional control voltages with or without applying a scaling factor. Moreover, the control voltages may be used as the input 12 to the VCO core 10 or as a control voltage input to the comparator 20. Therefore, the comparator 20 may be controlled by a sequence of preloaded control voltages. The sequence of analog control voltages may be selected by any suitable techniques. In some embodiments, the control voltages are selected by random and/or arbitrary variable generation. The control voltages may be based on a desired waveform output selected by a user and/or based on control voltages and/or other parameters selected by a user.

Variable core VCOs according to some embodiments may be used to generate waveform outputs including traditional analog-only sawtooth and triangle waveforms, complex waveforms of various repeating shapes and arbitrary waveforms with some random elements in analog-mode and using a controller such as a microprocessor for advanced control including digital timing and control of the controller during operation. For example, random or arbitrary values for various values, such as the control voltage values, timing values or reset values may be used to create an arbitrary waveform. It should be noted that the term "random" includes quasi-random or partially random selection, and arbitrary values may include values generated by equations in a non-random manner.

The voltage-controlled oscillators described herein may be used with electronic musical instruments, such as synthesizers, including analog bass synthesizers, full-range analog monophonic synthesizers, analog polyphonic synthesizers, as well as generating control voltage and modulation sources such commonly used in low-frequency oscillators (LFO's) or general control circuits and the like.

Figure 3:
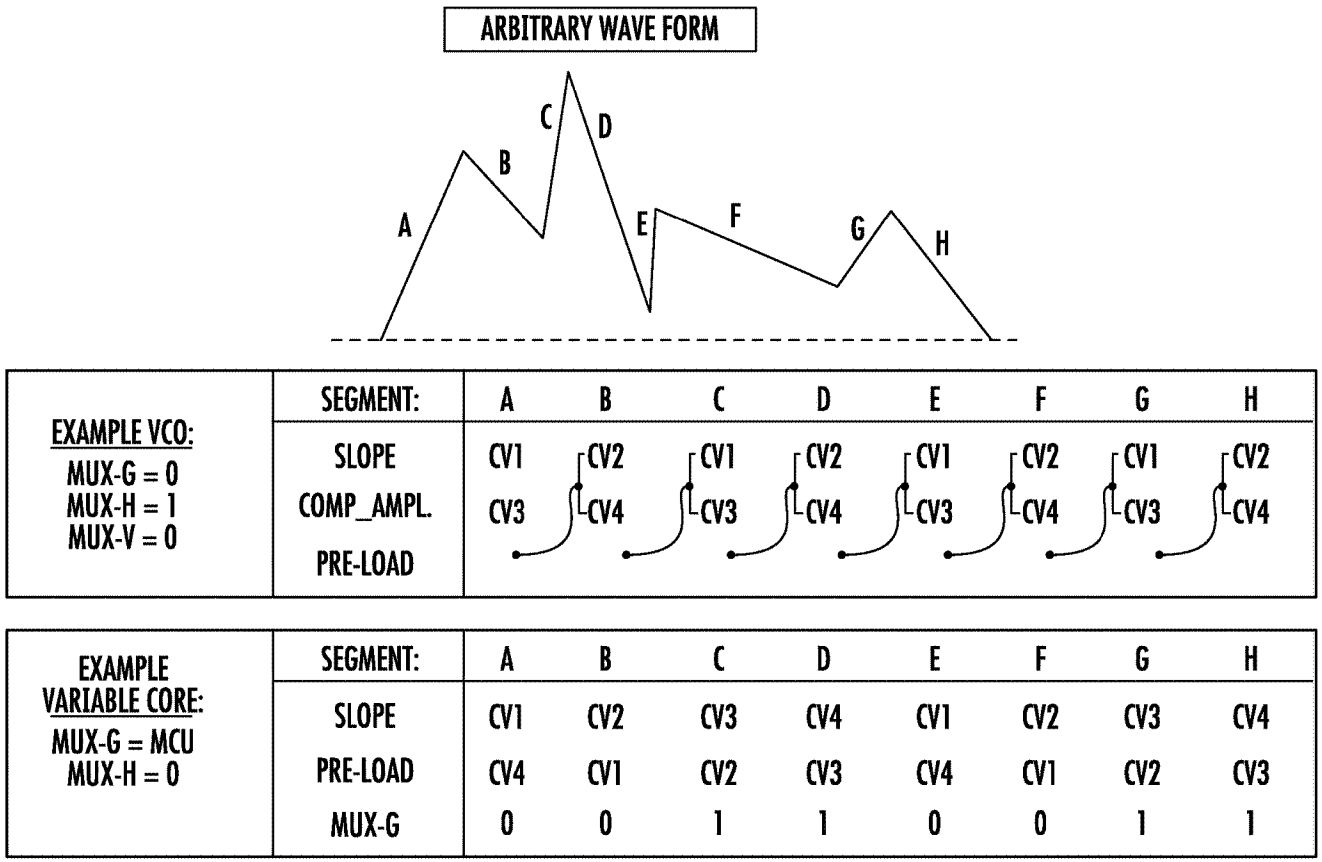
FIG. 3 is a schematic diagram of an arbitrary waveform and example control voltage values that may be generated by the circuit of FIG. 2.

An example arbitrary waveform output is shown in FIG. 3. As illustrated, the waveform includes segments A-H. Each segment has an associated slope and amplitude. The slope is determined by how quickly the capacitor in the VCO core is charged/discharged and is related to the input control voltage applied to the capacitor of the VCO core (e.g., VCO core 10 of FIGS. 1 and 2). The amplitude of each of the segments A-H is the target voltage that the waveform reaches at the end of the segment in a given amount of time. In a traditional VCO mode, the amplitude is applied to an analog comparator (e.g., comparator 20 in FIG. 2), which then indicates that the target voltage has been reached. The comparator output may then be used to switch the VCO core to the next segment either directly or using microprocessor controls.

In some embodiments, dynamically evolving waveforms may be generated. A static waveform generated in a traditional VCO core is typically constant in shape and harmonic content. In a multi-timbral variable core VCO, such as shown in FIGS. 1 and 2, the fundamental frequency of the waveform may be held static while the waveform topology may be modified to provide complex variations in harmonic content over time. Accordingly, an analog musical instrument may use the variable core VCO described herein to either more closely mimic qualities of acoustic instruments and/or to generate unique, artificial sounds.

VCO MODE (No Timing Control from the Controller)

In this mode, multiplexer 28 is set to 1, allowing the output of the comparator 20 to be directly connected to the multiplexers 22 and 28. The multiplexer 26 is set to 0 which routes CV1 and CV2 through the multiplexer 22 to the SLOPE inputs to the VCO core. CV3 and CV4 are routed through multiplexer 24 to the target AMPLITUDE inputs to the comparator 20.

For segment A, CV1 (multiplexer 22:0) and CV3 (multiplexer 24:0) are selected allowing the VCO to integrate with a SLOPE(CV1) until reaching AMPLITUDE(CV3). During this time, the microprocessor preloads the SLOPE and AMPLITUDE for segment B so that when the comparator toggles at AMPLITUDE(A), CV2 and CV4 are stable and accurate, at which point segment B begins.

Segment B has a slope of CV2 (multiplexer 22:1) and amplitude of CV4 (multiplexer 24:1) and similarly during this period the microprocessor is preloading CV1 and CV3 for the appropriate values required for segment C.

Accordingly, in the VCO mode, waveforms may be generated from completely simple one-segment waveforms (sawtooth) to waveforms of arbitrary segment number and length. However, this approach will need to address the physical limitations of the devices used such as DAC settling time, PWM filter settling time, processor power, costs, board space, etc. Thus, the scalability of this approach and the increasing capabilities as more control-voltage inputs, higher processing power, etc. are added may be limited.

Variable Core Mode

As shown in FIG. 3, the multiplexer 26 is toggled by the microprocessor controller 100 to allow all four control voltages CV1, CV2, CV3 and CV4 to be used as SLOPE inputs to the VCO core 10. Therefore, the control voltages for up to three segments may preloaded. The VCO core output may be monitored by the microprocessor using an ADC (e.g., ADC 36 in FIG. 2), which allows the controller 100 to determine both the state of the VCO core 10 and to determine when to switch to the next waveform segment.

One potential advantage of using CV3 and CV4 as SLOPE inputs is that it allows the control voltages to be preloaded earlier or more quickly than in VCO mode. The settling time of the DAC or PWM filter used to generate the control-voltage may have already transpired when the control voltage is applied. Accordingly, very fast transitions in the waveform (such as shown with respect to segment E) may be achieved.

Both the VCO mode and the variable core mode are scalable and affected by the hardware choices, such as the processing power of the controller, the number of control voltage inputs used, the latency of input triggers, ADC conversion times etc.

In some embodiments, the VCO core 10 is calibrated using the output of the comparator 20 and the ADC 36 as inputs to the microprocessor. Calibration may be used to execute desired waveform segments with reduced latency, jitter and accuracy. The controller may monitor the waveforms in real-time and use real-time calibration using techniques such as PID loops.

In some embodiments, using modern low-cost microprocessors with high resolution PWM hardware capable of micro-stepping duty-cycle, a temperature-stable integrator-reset oscillator can be achieved for a true VCO with high accuracy and repeatability over a usable range for music analog synthesis design.

Some embodiments may achieve a reduction in temperature dependency which allows a great deal of circuit simplification, cost-reduction and an increase in sonic flexibility over traditional VCO architectures.

According to some embodiments, various types of waveforms may be created. Some limitations to the types of waveforms may be related to the amount of processing power and latency issues inherent in the MCU. For very simple implementations, a very full array of sounds could be implemented using an inexpensive MCU, but for applications requiring more and more complex solutions, a higher-speed MCU/DSP may be used.

Basic operating modes and combinations thereof may be used to create complex waveforms from the oscillator core according to some embodiments. Various waveforms will now be described in the following non-limiting examples.

Figure 4:
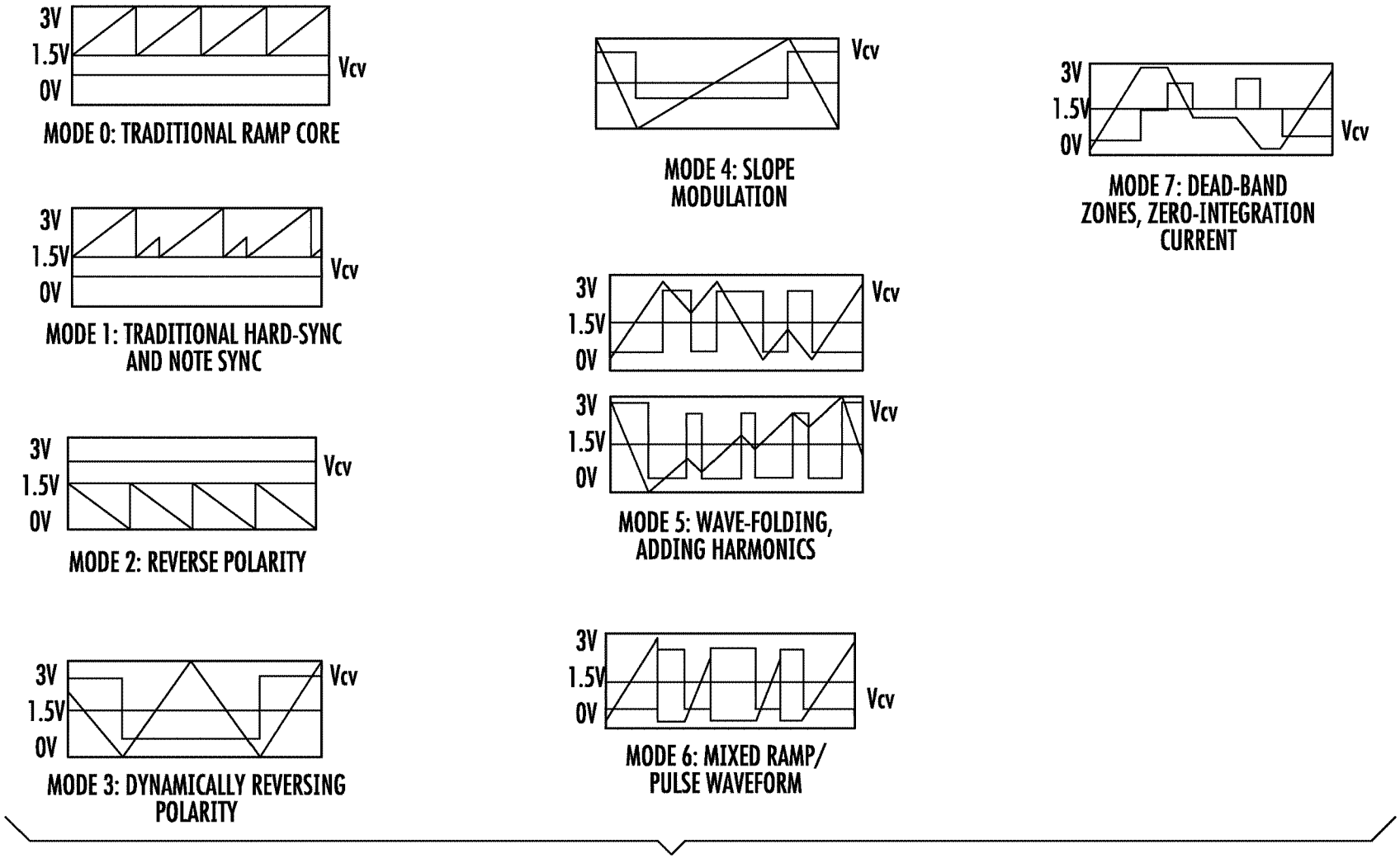
FIG. 4 are schematic diagrams of example waveforms that may be generated according to some embodiments.

Below is a list of waveforms that a VC-VCO could create according to some embodiments including the simplest traditional VCO modes all the way to completely arbitrary waveform generation. Some of the waveforms are illustrated in FIG. 4. While these illustrations show static waveforms, it should be understood that the waveforms may be dynamically changed over time so that the harmonic content is richly modulated. Therefore, the waveforms described below can be considered as a snap-shot in time.

Mode 0: Traditional Ramp Core

This mode creates the traditional sawtooth mode and can be done without microprocessor intervention but configures the VCO-core to act as a traditional VCO.

Mode 1: Traditional Hard-Sync and Note Sync

The VCO core can be re-triggered externally (e.g. from another oscillator) or from the microprocessor to create traditional hard-sync waveforms.

Mode 2: Reverse Polarity

The polarity of the Ramp is reversed to a Sawtooth waveform by reversing the polarity of the input slope and target. This would correlate to discharging the integrating capacitor rather than charging it. While sonically, this is harmonically identical to the first sawtooth example, it has implications for the waveform generation examples that follow.

Mode 3: Dynamically Reversing Polarity

In this example, the control protocol is used to dynamically change the ramping polarity based on a location in the phase of the waveform. In the example shown, a triangle wave is generated where the slopes and amplitudes of each segment are equal.

Mode 4: Slope Modulation

In this mode, the duty-cycle of the different phases of the waveform are varied either dynamically or statically to create anti-symmetric waveforms.

Mode 5: Wave-Folding, Adding Harmonics

Using precise control of ramp times complex wave-folding and additive waveforms may be added as illustrated in FIG. 4.

Mode 6: Mixed Ramp/Pulse Waveforms

A complex set of waveforms can be generated and modulated by switching between the slow and fast ramp times of the VCO core.

Mode 7: Dead-Band Zones, Zero-Integration Current

The VCO core can be calibrated for offset voltage and bias currents, so that a null current situation is created. This would allow for areas of the waveform that had no integration current and hence flat curves as illustrated in FIG. 4.

Mode 8: Arbitrary Waveforms (not Shown)

It would be very straight forward to output arbitrary waveforms to the VCO as described in the illustration and outlined in this section. Random slopes/ramps as well as wavetables could all be generated at-will. Depending on the integrating time-constants of the VCO, segments do not even have to have constant control-voltage inputs, allowing the invention to create complex waveforms with evolving slopes (a simple implementation of this might be the sine wave). Not all of these waveforms would create usable musical sounds, but would open up whole new areas of explorations. FIG. 3 demonstrates how one can approach arbitrary, evolving waveform generation with this invention.

Mode 9: Hybrid Modes

There is a virtually endless amount of combinations of the modes listed above and more that can be created and modulated to create a vast array of new waveforms from this analog VCO. Mode combinations which are musically compelling may be determined and a user interface to create these complex control voltages may be arranged.

Digital Timing and Comparator-Based Timing:

There are two fundamentally different time-bases that can be used to control the VCO core:

Comparator-Based (Analog):

In this timing model, state-transitions may be chosen based on the timing of comparator triggers. The timing may be based on the analog result of looking at the VCO output voltage compared to the comparator reference voltage. Getting an accurate frequency response that is repeatable has been proven in previous instruments, but requires a very tight calibration routine that allows the MCU to interpolate and calculate on the fly. This approach uses control voltages to generate the types of waveforms chosen by the input model.

MCU-Based (Digital):

An MCU may be used to keep track of time. With the proposed oscillator design described herein, all waveforms can also be generated using the digital time-base to attain waveforms in the time-domain.

The fact that there are two ways to control the timing of the wave generation in the VCO allows an additional amount of control and complexity (or simplicity) to the VCOs ability. In a polyphonic synthesizer, there are times where having an extremely precise control of frequency may be advantageous, especially when many voices are employed each with very complex harmonic content. Many modern polyphonic "analog" synthesizers employ digital oscillators for this very reason.

In some embodiments, the variable core VCO oscillator approach may be used to mix and match the outputs to best meet the needs of the sonic requirements imposed by the artist.

Voltage-controlled oscillators according to some embodiments may use the hardware resources of a modern MCU to tightly integrate a traditional integrator-reset oscillator in with complex control-voltage generation. Using the power and high-resolution capabilities of the MCU, both simple/traditional waveforms can be generated in the purely analog realm with very high precision and a full-range across the musical spectrum as well as more non-traditional and harmonically complex waveforms that employ a variety of computational techniques. Accordingly, new types of waveforms previously unattainable by a traditional analog VCO may be created.

Because modern MCU's have become faster and Motor Control applications using PWM have become important to the chip manufacturer's customer base in recent years, there have been improvements in the speed, capabilities and costs of MCU's capable of creating very accurate and complex PWM pulse trains. Recently, low-cost and powerful 32-bit floating point microprocessors have been available with a "high-resolution" PWM technology that allows PWM step resolution at 100 to 200 times the speed of the processor's clock rate. This may enable extremely high-accuracy control of control-voltage generation that was previously unavailable. For example, a 100 MHz processor would have a minimum step-size of 10 nsec (or 1×10E-8 seconds). Generating a 10 bit PWM resolution would require 1024 steps, or 1024*10 nsec, or 10.24 usec, yielding a PWM frequency of close to 100 KHz. In a microprocessor that has micro-stepping resolution of 150 psec, a 100 KHz PWM gives a step resolution of ~66666 steps or >16-bit accuracy. It will be understood that slower PWM frequency can further increase the step resolution or effective bits of resolution.

The PWM pulse train is duty-cycle modulated. To convert this to an analog signal, a high-quality active low-pass filter is used. The design of this filter is a dictated by a number of design requirements and it is important to find the correct balance that yields the resolution, low ripple with high frequency, yet retains a fast enough response time to generate the range of frequencies that you would like to generate. Accordingly, an integrating oscillator may be controlled with high enough accuracy and sonic clarity to be used in analog synthesis. The micro-processor may also be responsible for measuring the sync pulses generated from the oscillator with high enough resolution to be able to accurately determine pitch. Modern micro-processors as described above have more than sufficiently accurate resolution to measure these frequencies accurately. This measurement is done to carefully calibrate the PWM duty cycle steps so that the oscillator can be accurately calibrated over a full range of audio frequencies of interest.

Additionally, mode Digital-To-Analog converters (DACs) have evolved to the point where fast, high-resolution (24-bits) of output are now cost-effective, industry-standard devices with well defined microprocessor interface specifications and implementations. Using DACs is a very practical approach to generating the necessary control-voltage inputs into the VCO core.

The specific choice of generating control voltages (DAC, PWM, other . . . ) will be specific to each instrument that deploys this invention and will be based on the many factors that determine the best choice of technology.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A signal generator for a musical instrument comprising:

a voltage-controlled oscillator (VCO) comprising a control voltage input and a VCO output, wherein the control voltage input controls a frequency of the VCO output; and a controller configured to control the voltage-controlled oscillator by inputting a sequence of analog control voltages from a plurality of preloaded control voltage inputs, wherein the control voltage sequence of analog control voltages is selected by random variable generation, is based on a desired waveform selected by a user, or is based on control voltages selected by a user or other parameters selected by a user or combinations thereof.

2. The signal generator of claim 1, wherein the controller is further configured to select at least one of the plurality of preloaded control voltage inputs and to simultaneously preload another of the plurality of control voltage inputs for subsequent selection.

3. The signal generator of claim 1, wherein the controller is configured to receive the VCO output and to adjust the control voltage sequence based on a comparison between a desired waveform output and the VCO output.

4. The signal generator of claim 1, wherein the voltage-controlled oscillator comprises at least one reset input configured to reset a phase of the VCO output, and the controller is configured to control the at least one reset input.

5. The signal generator of claim 1, wherein the controller further comprises at least one control voltage selection multiplexer configured to select one of the plurality of control voltage inputs.

6. The signal generator of claim 1, further comprising an analog mode multiplexer configured to select between a microprocessor control mode and a conventional voltage controlled oscillator mode in which microprocessor control is disabled.

7. The signal generator of claim 1, wherein the controller is configured to combine at least two of the plurality of preloaded control voltage inputs to provide a modified control voltage input to the voltage controlled oscillator.

8. The signal generator of claim 7, wherein combining ones of the plurality of preloaded control voltages comprises adding or multiplying at least two of the plurality of preloaded control voltage inputs.

9. The signal generator of claim 1, wherein the controller comprises a microprocessor.

10. A musical instrument comprising:

the signal generator according to claim 1; and a tone generator configured to produce a sound responsive to the VCO output.

11. A signal generator for a musical instrument comprising:

a voltage-controlled oscillator (VCO) comprising a control voltage input and a VCO output, wherein the control voltage input controls a frequency of the VCO output;

a controller configured to control the voltage-controlled oscillator by inputting a sequence of analog control voltages from a plurality of preloaded control voltage inputs; and a comparator that defines an amplitude of the VCO output, wherein the controller is further configured to control the amplitude defined by the comparator using a sequence of preloaded comparator voltages.

12. The signal generator of claim 11, further comprising an analog mode multiplexer configured to select between a microprocessor control mode and a conventional voltage controlled oscillator mode in which microprocessor control is disabled.

13. A method for generating a signal for a musical instrument comprising:

providing a voltage-controlled oscillator (VCO) comprising a control voltage input and a VCO output, wherein the control voltage input controls a frequency of the VCO output;

controlling the voltage-controlled oscillator by inputting a control voltage sequence of analog control voltages selected from a plurality of preloaded control voltage inputs; and selecting the sequence of control voltages by random variable generation, based on a desired waveform selected by a user or based on control voltages or other parameters selected by a user or combinations thereof.

14. The method of claim 13, further comprising selecting at least one of the plurality of preloaded control voltage inputs and simultaneously preloading another of the plurality of control voltage inputs for subsequent selection.

15. The method of claim 13, further comprising adjusting the control voltage sequence based on a comparison between a desired waveform output and the VCO output.

16. A method for generating a signal for a musical instrument comprising:

providing a voltage-controlled oscillator (VCO) comprising a control voltage input and a VCO output, wherein the control voltage input controls a frequency of the VCO output;

controlling the voltage-controlled oscillator by inputting a control voltage sequence of analog control voltages selected from a plurality of preloaded control voltage inputs; and providing a comparator that defines an amplitude of the VCO output, wherein method comprises controlling the amplitude of the VCO output using a sequence of preloaded comparator voltages.

17. The method of claim 13, wherein the voltage-controlled oscillator comprises at least one reset input configured to reset a phase of the VCO output, the method further comprising controlling the at least one reset input.

18. The method of claim 13, further comprising selecting between a microprocessor control mode and a conventional voltage controlled oscillator mode in which microprocessor control is disabled.

19. The method of any claim 13, further comprising combining at least two of the plurality of preloaded control voltage inputs to provide a modified control voltage input to, the voltage controlled oscillator.

20. The method of any claim 13, wherein combining ones of the plurality of preloaded control voltages comprises adding or multiplying at least two of the plurality of preloaded control voltage inputs.

21. The method of claim 16, further comprising selecting between a microprocessor control mode and a conventional voltage controlled oscillator mode in which microprocessor control is disabled.

22. A signal generator for a musical instrument comprising:

a voltage-controlled oscillator (VCO) comprising a control voltage input and a VCO output, wherein the control voltage input controls a frequency of the VCO output;

a controller configured to control the voltage-controlled oscillator by inputting a sequence of analog control voltages from a plurality of preloaded control voltage inputs; and a comparator that defines an amplitude of the VCO output, wherein the controller is further configured to control the amplitude defined by the comparator using a sequence of preloaded comparator voltages, where in the controller further comprises a multiplexer configured to define some of the plurality of VCO control voltages as selectable as inputs to the VCO and to define others of the plurality of VCO control voltages as selectable as the sequence of preloaded comparator voltages.

* * * * *